US006005918A

United States Patent [19]

Harris et al.

[11] Patent Number: 6,005,918

[45] Date of Patent: Dec. 21, 1999

[54] X-RAY TUBE WINDOW HEAT SHIELD

[75] Inventors: Jason P. Harris, Schaumburg; Gerald J. Carlson, Lombard, both of Ill.; Lester D. Miller, Hudson, Ohio

[73] Assignee: Picker International, Inc.

[21] Appl. No.: 08/994,637

[22] Filed: Dec. 19, 1997

[51] Int. Cl.[6] ..... H01J 35/18

[52] U.S. Cl. ..... 378/140; 378/137; 378/161

[58] Field of Search ..... 378/140, 119, 378/121, 142, 137, 138, 113, 161

[56] References Cited

U.S. PATENT DOCUMENTS

| | | |
|---|---|---|
| 4,309,637 | 1/1982 | Fetter . |
| 4,731,804 | 3/1988 | Jenkins . |
| 5,128,977 | 7/1992 | Danos . |
| 5,206,895 | 4/1993 | Danos . |
| 5,511,104 | 4/1996 | Mueller et al. . |

*Primary Examiner*—David P. Porta
*Attorney, Agent, or Firm*—Timothy B. Gurin; John J. Fry; Eugene E. Clair

[57] ABSTRACT

An x-ray tube includes an envelope defining an evacuated chamber and having a window transmissive to x-rays. An anode assembly and a cathode assembly operate within the envelope to produce x-rays which travel through the window transmissive to x-rays towards a patient or subject under examination. A shield transmissive to x-rays is coupled to the envelope and positioned such that x-rays traveling through the window transmissive to x-rays must first travel through the shield. The shield prevents substantially all secondary electrons created during the production of x-rays from coming into contact with the window transmissive to x-rays thereby preventing excessive heating of the window transmissive to x-rays. An electrode defined by the envelope in a region proximate the window transmissive to x-rays may additionally or alternatively be used to prevent secondary electrons from reaching the window transmissive to x-rays.

29 Claims, 4 Drawing Sheets

X-RAY TUBE WINDOW HEAT SHIELD

TECHNICAL FIELD

The present invention relates to x-ray tube technology. More specifically, the present invention relates to the prevention of excessive heating of an x-ray tube window by reducing the amount of secondary electrons reaching an x-ray tube window.

BACKGROUND OF THE INVENTION

Conventional diagnostic use of x-radiation includes the form of radiography, in which a still shadow image of the patient is produced on x-ray film, fluoroscopy, in which a visible real time shadow light image is produced by low intensity x-rays impinging on a fluorescent screen after passing through the patient, and computed tomography (CT) in which complete patient images are electrically reconstructed from x-rays produced by a high powered x-ray tube rotated about a patient's body.

Typically, a high power x-ray tube includes an evacuated envelope made of metal or glass which holds a cathode filament through which a heating current is passed. This current heats the filament sufficiently that a cloud of electrons is emitted, i.e. thermionic emission occurs. A high potential, on the order of 100–200 kV, is applied between the cathode and an anode which is also located in the evacuated envelope. This potential causes the electrons to flow from the cathode to the anode through the evacuated region in the interior of the evacuated envelope. A cathode focusing cup housing the cathode filament focuses the electrons onto a small area or focal spot on the anode. The electron beam impinges the anode with sufficient energy that x-rays are generated. A portion of the x-rays generated pass through an x-ray transmissive window of the envelope to a beam limiting device, or collimator, attached to an x-ray tube housing. The beam limiting device regulates the size and shape of the x-ray beam directed toward a patient or subject under examination thereby allowing images of the patient or subject to be reconstructed.

During the production of x-rays, many electrons from the electron beam striking the anode are reflected from the anode and fall upon other regions of the x-ray tube. The reflected electrons are often referred to as secondary electrons, and the act of such reflected electrons falling on other regions of the x-ray tube is often referred to as secondary electron bombardment. Secondary electron bombardment causes substantial heating to the regions in which the secondary electrons fall.

In x-ray tubes having a metal envelope, secondary electrons are often attracted to the metal envelope which is at ground potential. Thus, portions of the metal envelope closest to where the x-rays are being produced are often substantially heated during operation of the x-ray tube due to secondary electron bombardment. The region along the metal envelope closest to where the x-rays are produced also is the region in which the window is coupled to the metal envelope. An air tight junction between the window and the metal envelope is therefore made such that it can withstand high temperatures without failure. With an ongoing desire to provide x-ray tube producing higher power exposures and shorter imaging times, the intensity of the electron beam striking the anode continues to increase. Unfortunately, this in turn has caused the amount of secondary electron bombardment to proportionally increase thereby making it increasingly difficult to provide a reliable air tight junction between the window and the metal envelope.

One known method of reducing the amount of secondary electron bombardment occurring at a junction between the window and the metal frame is described in U.S. Pat. No. 5,511,104 assigned to Siemens Aktiengesellschaft. The '104 Patent provides a first electrode at anode potential and a second electrode at cathode potential positioned such that secondary electrons emanating from the anode must pass through a space between the first and second electrodes in order to reach the window. Since secondary electrons passing through the space are attracted to the electrode at anode potential, fewer secondary electrons reach the window thus avoiding excessive heating at the junction between the window and the envelope. One main drawback to the '104 patent is that x-ray tubes configured with this design are typically limited to single ended designs where the anode is at ground potential and the cathode is at −150,000 volts, for example. If a bi-polar arrangement was used in conjunction with the design described in the '104 patent where the anode was at a positive voltage potential (i.e. +75,000 volts) and the cathode was at a negative voltage potential (i.e. −75,000 volts), for example, positioning the electrodes such that arcing does not occur between the electrodes and the anode and/or the cathode becomes extremely difficult since placement of the electrodes between the anode and the cathode would likely alter the electric field concentration between these elements in a manner that would cause arcing to occur. Unfortunately this makes it difficult for such x-ray tubes to be used in a retrofit manner since most x-ray tubes have generators which are configured to handle only a bi-polar topology.

Therefore, what is needed is an apparatus for reducing the amount of secondary electron bombardment at a junction between the window and a metal envelope which overcomes the shortfall described above.

SUMMARY OF THE INVENTION

In accordance with the present invention, an x-ray tube is provided. The x-ray tube includes an anode defining a target for intercepting a beam of electrons such that collision between the electrons and the anode generate x-rays from an anode focal spot. The x-ray tube also includes a cathode having a filament which emits electrons when heated. A tube envelope encloses the anode and the cathode in a vacuum. The tube envelope includes an x-ray transmissive window through which x-rays generated by the anode pass and the x-ray tube includes a means for intercepting secondary electrons reflected from the anode before the secondary electrons strike the x-ray transmissive window.

In accordance with another aspect of the present invention an x-ray tube is provided. The x-ray tube includes an envelope having an x-ray transmissive window. The envelope defines an evacuated chamber in which operation of an anode assembly and a cathode assembly produce x-rays and secondary electrons. The x-ray tube also includes a shield disposed in the envelope for insulating the x-ray transmissive window from the heating effects of the secondary electrons.

In accordance with yet another aspect of the present invention, an x-ray tube is provided. The x-ray tube includes an anode defining a target for intercepting a beam of electrons such that collision between the electrons and the anode generate x-rays from an anode focal spot. The x-ray tube also includes a cathode having a filament which emits electrons when heated. A tube envelope encloses the anode and the cathode in a vacuum. The tube envelope includes an x-ray transmissive window through which x-rays generated by the anode pass and the x-ray tube includes a means for preventing a portion of secondary electrons reflected from the anode from reaching the x-ray transmissive window, the means defined by the envelope.

In accordance with still another aspect of the present invention, an x-ray tube is provided. The x-ray tube includes an evacuated envelope having an x-ray transmissive window, an anode mounted within the evacuated envelope and connected with a rotor to provide rotation thereof, and a cathode for generating a beam of electrons which impinge upon the rotating anode on a focal spot to generate a beam of x-rays. An improvement of the x-ray tube includes a means for blocking a portion of secondary electrons reflected from the anode from striking the x-ray transmissive window.

One advantage of the present invention is that a substantial portion of secondary electrons are prevented from reaching and excessively heating an x-ray transmissive window which maintains an air tight seal with the x-ray tube envelope.

Another advantage of the present invention is that excessive heating of the x-ray transmissive window which maintains an air tight seal with the x-ray tube envelope is prevented while allowing the x-ray tube to be configured with a bi-polar arrangement.

To the accomplishment of the foregoing and related ends, the invention then, comprises the features hereinafter fully described and particularly pointed out in the claims. The following description and the annexed drawings set forth in detail certain illustrative embodiment of the invention. These embodiments are indicative, however, of but a few of the various ways in which the principles of the invention may be employed. Other objects, advantages and novel features of the invention will become apparent from the following detailed description invention when considered in conjunction with the drawings.

DETAILED DESCRIPTION OF THE PREFERRED EMBODIMENTS

Figure 1:
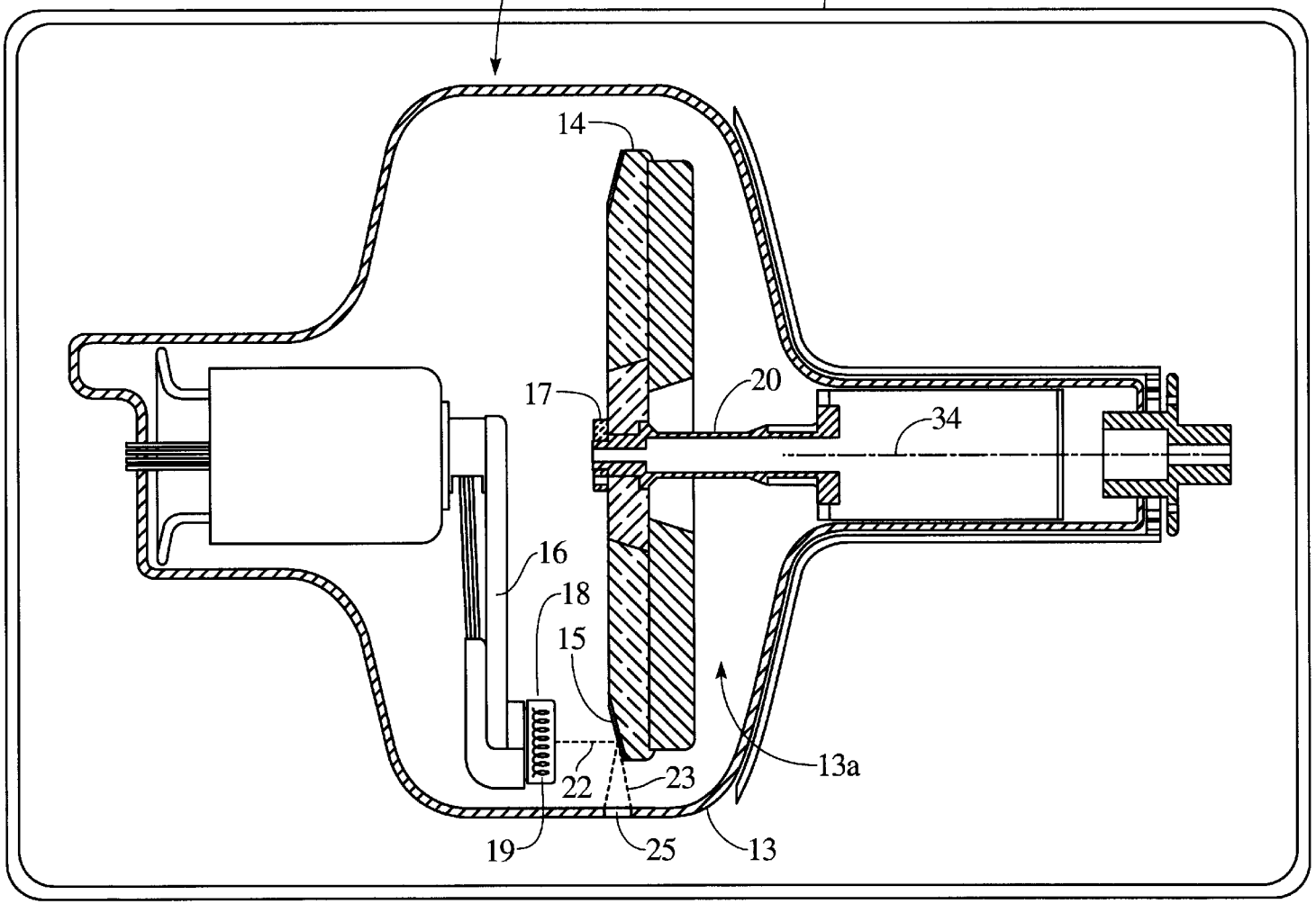
FIG. 1 is a partial cross sectional view of an x-ray tube in accordance with the present invention.

The present invention will now be described with reference to the drawings in which like reference numerals are used to refer to like elements throughout.

Turning now to FIG. 1, an x-ray tube 10 is shown to be mounted within an x-ray tube housing 12. The x-ray tube 10 includes an envelope 13 defining an evacuated chamber or vacuum 13*a*. In the preferred embodiment, the envelope 13 is made of copper although other suitable metals could also be used. Disposed within the envelope 13 is an anode assembly 14 and a cathode assembly 16. The anode assembly 14 is mounted to a rotor 20 using securing nut 17 and is rotated about an axis of rotation 34 during operation as is known in the art. The anode assembly 14 includes a target area 15 along a peripheral edge of the anode assembly 14 which is comprised of a tungsten composite or other suitable material capable of producing x-rays. The cathode assembly 16 is stationary in nature and includes a cathode focusing cup 18 positioned in a spaced relationship with respect to the target area 15 for focusing electrons to a focal spot on the target area 15. A cathode filament 19 mounted to the cathode focusing cup 18 is energized to emit electrons 22 which are accelerated to the target area 15 of the anode assembly 14 to produce x-rays 23. Upon contacting the target area 15, a portion of the electrons 22 reflect from the target area 15 and scatter within the evacuated chamber 13*a* of the envelope 13. The reflected electrons are known as secondary electrons. The electrons 22 which are absorbed, as opposed to reflected, by the anode assembly 14 serve to produce the x-rays 23, a portion of which pass through an x-ray transmissive window assembly 25 coupled to the envelope 13 towards a patient or subject under examination. The window assembly 25 of the present invention is described in more detail below with respect to FIGS. 2–4. In the present embodiment, the anode assembly 14 and the cathode assembly 16 are configured in a bi-polar relationship whereby the anode assembly 14 is at a positive voltage potential (i.e. +75,000 volts) and the cathode assembly 16 is at a negative voltage potential (i.e. −75,000 volts). It will be appreciated that the anode assembly 14 and the cathode assembly 16 may be configured to other suitable bi-polar voltage potentials or be configured in a single ended relationship with respect to one another where the anode assembly 14 is at ground potential.

Figure 2:
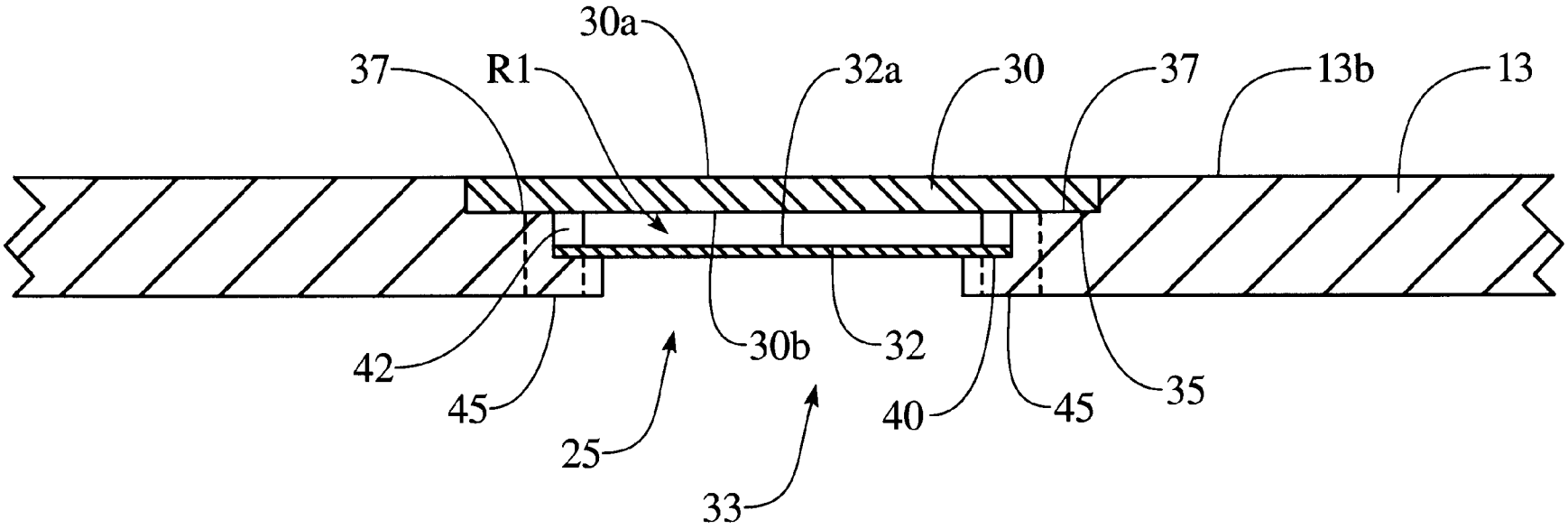
FIG. 2 is an enlarged cross sectional view of an envelope and window assembly of the x-ray tube of FIG. 1.
Figure 3:
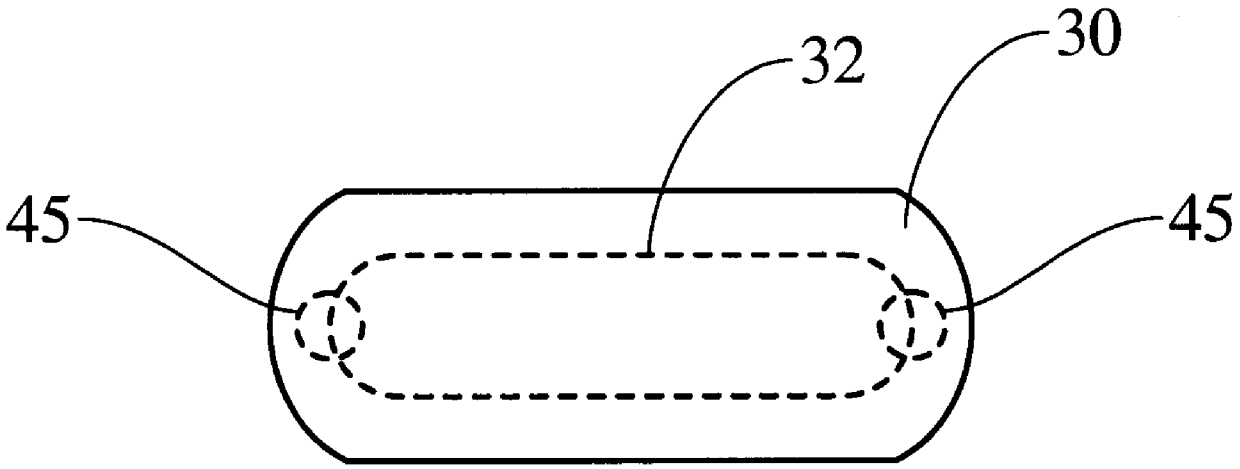
FIG. 3 is a top view of the window assembly of FIG. 2.

Referring now to FIGS. 2 and 3, the window assembly 25 of the present embodiment is shown in more detail. The window assembly 25 includes a main window 30 and a shield 32 each situated in a spaced relationship with respect to one another within an opening 33 in the envelope 13. The main window 30 and the shield 32 are each made of material transmissive to x-rays such as Beryllium. It will be appreciated, however, other suitable x-ray transmissive material such as graphite, berylla, copper, or other materials sized sufficiently thin such that they minimally filter x-rays could alternatively be used.

The main window 30 is shown to be situated along a first step 35 of the envelope 13 such that a top surface 30*a* of the main window 30 is flush with a top surface 13*a* of the envelope 13. A portion of a bottom surface 30*b* of the main window 30 is brazed to the envelope 13 along a junction 37 thereby forming an air tight seal. It will be appreciated that other known methods of creating an air tight connection between the main window 30 and the envelope 13 such as diffusion bonding and welding could alternatively be used.

The shield 32 is situated on a second step 40 of the envelope 13. The shield 32 is mechanically held in place by virtue of a retaining spring 42 situated between the bottom surface 30*b* of the main window 30 and a top surface 32*a* of the shield 32. The retaining spring 42 allows for slight movement by the shield 32 which may occur due to temperature variances seen by the shield 32. It will be appreciated that a spring washer or other suitable mechanical device could be used in place of the retaining spring 42 for securing the shield 32 in place. Further, it will be appreciated that the shield 32 could be sized to frictionally fit with respect to the envelope 13 such that no retaining spring 42 or other mechanical device is required. Additionally, the shield 32 may be screwed, swayed, or otherwise secured in place.

Continuing to refer to FIGS. 2 and 3, a pair of vent holes 45 shown in phantom create a passage from a region R1, defined between the bottom surface 30*b* of the main window 30 and the top surface 32*a* of the shield 32, to the evacuated chamber 13*a* defined by the envelope 13. As discussed in more detail below, the pair of vent holes 45 help ensure that no undesired air or gas molecules are accidentally trapped between the main window 30 and the shield 32 during assembly.

In operation, assembly of an x-ray tube 10 having the window assembly 25 involves initially drilling the vent holes 45 into the envelope 13. Next, the shield 32 is placed onto the second step 40 of the envelope 13 and the retaining spring 42 is placed on the top face 32*a* of the shield 32 for mechanically securing the shield 32 in place. The main window 30 is then brazed or otherwise affixed along the first step 35 of the envelope 13 such that an air tight seal is formed at the junction 37 and such that the main window 30 engages with the retaining spring 42 to place sufficient pressure on the shield 32 to hold the shield 32 in place. The vent holes 45 aid in preventing air from becoming trapped in the region R1. More specifically, following assembly of the main window 30 and the shield 32, the envelope 13 is pumped of gas and air in accordance with known techniques in the art. Due to the vent holes 45, any air which may otherwise be trapped in the region R1 is able to be readily pumped from the envelope 13. If the vent holes 45 were not present, it would be possible for air trapped in the region R2 to slowly seep into the evacuated chamber 13*a* of the envelope 13 during operation of the x-ray tube since there is no air tight seal between the shield 32 and the envelope 13.

During operation of the x-ray tube 10, a substantial portion of the secondary electrons which are scattered towards the main window 30 are intercepted or blocked by the shield 32 and thus prevented from reaching the main window 30. Thus, the shield 32 serves to insulate the main window 30 from the heating effects of the secondary electrons. Heat dissipated by the secondary electrons is absorbed by the shield 32 and transferred to the envelope 13 at a junction between the shield 32 and the envelope 13 along the second step 40. Heat dissipated by secondary electrons colliding with the shield 32 does not substantially affect the integrity of the evacuated state of the envelope 13 since the connection between the shield 32 and the envelope 13 does not play a part in maintaining the evacuated state of the envelope 13 . Since substantially all the secondary electrons are prevented from reaching the main window 30, excessive heating of the main window 30 which may deleteriously affect the air tight junction between the main window and the envelope 13 is diminished. It will be appreciated that heat transferred to the envelope 13 by the shield 32 or otherwise directly absorbed by the envelope 13 does not play a substantial role in reducing the reliability of the air tight junction between the main window 30 and the envelope 13 as such heat is readily dissipated across the entire envelope 13. Further, as the shield 32 is made of a thin, x-ray transmissive material, the shield 32 does not serve to substantially affect the amount of x-rays transmitted through the envelope 13 towards a patient or subject under examination.

Because the shield 32 is at ground potential and is spaced a sufficient distance away from the anode assembly 14 and cathode assembly 16 such that arcing is not drawn to the shield 32, the present invention allows for the x-ray tube to be configured in a bi-polar arrangement.

Figure 4:
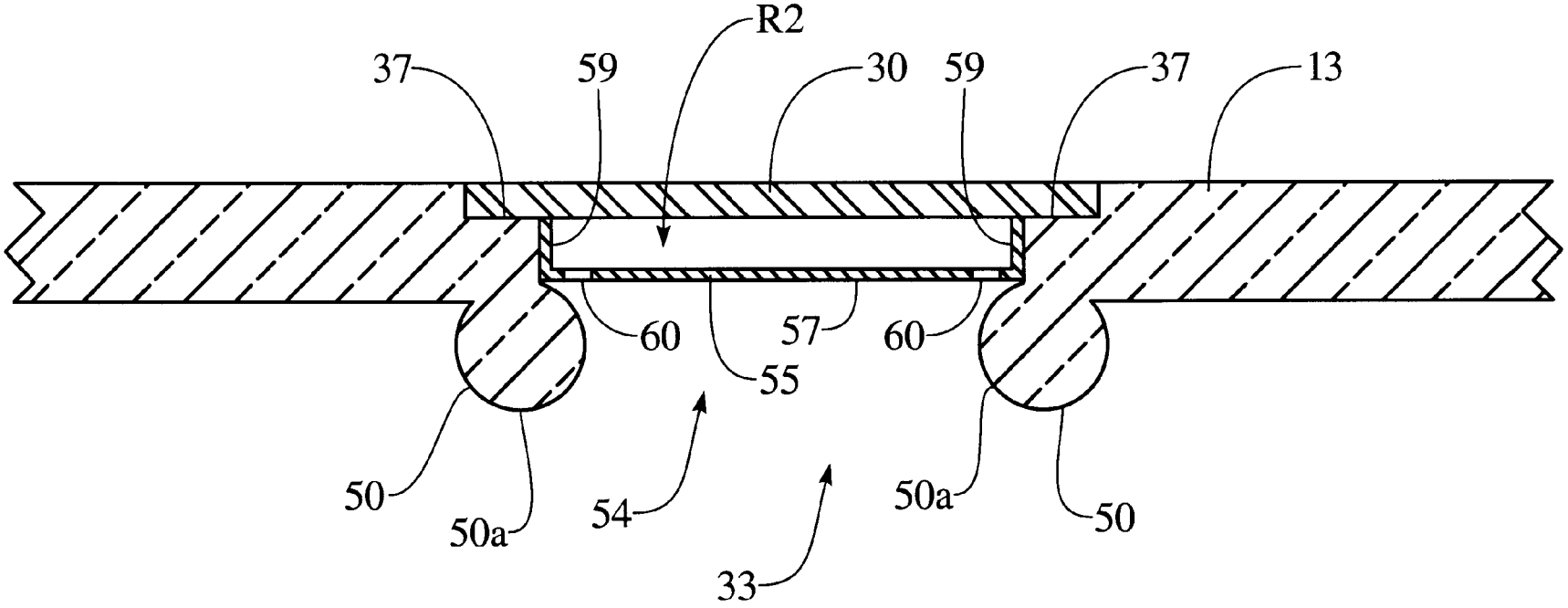
FIG. 4 is an enlarged cross sectional view of an envelope and window assembly in accordance with an alternative embodiment of the present invention.

Referring now to FIG. 4, an alternative embodiment of the present invention is shown. In the present embodiment, a portion of the envelope 13 is shaped to define an electrode 50. More specifically, the electrode 50 is formed by a portion of the envelope 13 which surrounds the opening 33 and thus is in close proximity to the main window 30. The shape of the electrode 50 is similar to that of a doughnut. More specifically, the electrode 50 includes a curved tubular face 50*a* which is shaped such that an electric field created by the electrode 50 attracts secondary electrons to the electrode 50. This in turn, reduces the number of secondary electrons approaching the opening 33 from coming into contact with a window assembly 54.

The window assembly 54 shown in FIG. 4 includes the main window 30 which is secured to the envelope 13 in an air tight manner as discussed above with reference to FIGS. 2 and 3. A shield 55 is also included as part of the window assembly 54 to further aid in shielding the main window 30 from secondary electrons. The shield 55 includes a window portion 57 and a side wall 59. The shield 55 is shaped and sized to frictionally press fit within the opening 33 in the envelope 13. The side wall 59 of the shield 55 is sized to be sufficiently thin such that substantially no heat is transferred from the window portion 57 of the shield 55 to the main window 30. The window portion 57 of the shield 55 includes a pair of vacuum holes 60 to aid in pumping air from a region R2 between the main window 30 and the shield 55. The materials for the main window 30 and shield 55 of the present embodiment may be any of those discussed above with respect to the window assembly 25 of FIG. 2.

In operation, assembly of the window assembly 54 includes press fitting the shield 55 to the envelope 13 and securing the main window 30 to the envelope 13 in an air tight manner as discussed above with respect to FIGS. 2 and 3. Because the shield 55 is press fit with respect to the envelope 13, there is no need for a retaining spring or washer thus reducing the number of parts needed for the window assembly 54. Further, the vacuum holes 60 in the window portion 57 of the shield 55 allow for air to be readily pumped from the region R2 prior to and during operation of the x-ray tube 10.

Continuing to refer to FIG. 4, secondary electrons which approach the opening 33 are initially drawn to the electrode 50 surrounding the opening 33. The electrode 50 thereby serves to substantially reduce the number of secondary electrons which reach the window assembly 54. As the electrode 50 is defined by and part of the envelope 13, the heat transferred to the electrode 50 by the secondary electrons is readily dissipated across the entire envelope 13. Thus, the air tight junction 37 between the main window 30 and the envelope 13 is not significantly affected by the secondary electrons which collide with the electrode 50. The shield 55 serves as a backup for the electrode 50 for restricting access to any additional secondary electrons traveling towards the main window 30. Heat dissipated by secondary electrons colliding with the window portion 57 of the shield 55 is primarily conducted to the envelope 13 by the window portion 57. As discussed above, very little heat is transferred to the main window 30 from the side wall 59 of the shield 55 given the small cross-sectional area of the side wall 59. Although the present embodiment shows use of the electrode 50 and shield 55 in combination to protect the main window 30 from secondary electrons, it will be appreciated that shield 55 or the electrode 50 could be used individually to protect the main window 30 from secondary electrons. Further, the electrode 50 could be used in combination with any other window assembly such as window assembly 25 discussed above with reference to FIGS. 2 and 3.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or their equivalence thereof.

What is claimed is:

1. An x-ray tube comprising:

an anode defining a target for intercepting a beam of electrons such that collision between said electrons and the anode generate x-rays from an anode focal spot;

a cathode for producing said electrons, said cathode including a filament which emits electrons when heated;

a tube envelope enclosing the anode and cathode in a vacuum;

an x-ray transmissive window through which x-rays generated by the anode pass, the window joined to the envelope with a vacuum tight seal; and means for intercepting secondary electrons reflected from the anode before said secondary electrons strike the x-ray transmissive window, the intercepting means secured to the envelope.

2. The x-ray tube of claim 1, wherein the means comprises a shield disposed in the envelope in a spaced relationship from the x-ray transmissive window.

3. The x-ray tube of claim 2, wherein the shield comprises x-ray transmissive material.

4. The x-ray tube of claim 2, wherein the shield is coupled to the envelope.

5. The x-ray tube of claim 4, wherein a spring loaded device disposed between the x-ray transmissive window and the shield secures the shield to the envelope.

6. The x-ray tube of claim 4, wherein the shield is frictionally fit to the envelope.

7. The x-ray tube of claim 4, wherein the envelope includes a vent hole defining a passage from a region between the shield and the x-ray transmissive window and the vacuum.

8. The x-ray tube of claim 4, wherein the shield includes a vent hole.

9. The x-ray tube of claim 1, wherein the envelope defines an electrode.

10. The x-ray tube of claim 9, wherein the electrode is in close proximity to the x-ray transmissive window.

11. The x-ray tube of claim 1, wherein the means is transmissive to x-rays.

12. An x-ray tube comprising:

an envelope made of a first material having an x-ray transmissive window made of a second material, said envelope defining an evacuated chamber in which operation of an anode assembly and a cathode assembly produce x-rays and secondary electrons; and a shield secured to the envelope for insulating the x-ray transmissive window from the heating effects of the secondary electrons.

13. The x-ray tube of claim 12, wherein the shield is transmissive to x-rays.

14. The x-ray tube of claim 13, wherein a spring loaded device disposed between the x-ray transmissive window and the shield mechanically secures the shield to the envelope.

15. The x-ray tube of claim 13, wherein the shield is frictionally coupled to the envelope.

16. The x-ray tube of claim 12, wherein envelope includes a vent hole leading from the evacuated chamber to a region between the x-ray transmissive window and the shield.

17. The x-ray tube of claim 12, wherein the shield includes a vent hole.

18. The x-ray tube of claim 12, wherein the envelope defines an electrode in a region proximate the x-ray transmissive window.

19. An x-ray tube comprising:

an anode maintained at a first electrical potential defining a target for intercepting a beam of electrons such that collision between said electrons and the anode generate x-rays from an anode focal spot;

a cathode maintained at a second electrical potential for producing said electrons, said cathode including a filament which emits electrons when heated;

a tube envelope enclosing the anode and the cathode in a vacuum, said envelope including an x-ray transmissive window made of metal, the window joined to the envelope and maintained at a third electrical potential; and means for preventing a portion of secondary electrons reflected from the anode from reaching the x-ray transmissive window, wherein said means is defined by the envelope and maintained at the third electrical potential.

20. The x-ray tube of claim 19, wherein the means is in close proximity to the x-ray transmissive window.

21. The x-ray tube of claim 20, wherein the means is an electrode.

22. The x-ray tube of claim 21, wherein the x-ray tube further comprises a shield, said shield intercepting a portion of the secondary electrons reflected from the anode before said secondary electrons strike the x-ray transmissive window.

23. The x-ray tube of claim 22, wherein the shield is disposed in the envelope in a spaced relationship from the x-ray transmissive window.

24. The x-ray tube of claim 23, wherein the shield comprises x-ray transmissive material.

25. The x-ray tube of claim 24, wherein the shield is coupled to the envelope.

26. In an x-ray tube including an evacuated metal envelope having an x-ray transmissive window joined to the envelope, an anode mounted within the evacuated envelope and connected with a rotor to provide rotation thereof, and a cathode for generating a beam of electrons which impinge upon the rotating anode on a focal spot to generate a beam of x-rays, the improvement comprising:

means for blocking a portion of secondary electrons reflected from the anode from striking the x-ray transmissive window, the blocking means secured to the evacuated envelope adjacent to an interior surface of the window.

27. The x-ray tube of claim 26, wherein the means comprises a shield disposed in the envelope in a spaced relationship from the x-ray transmissive window.

28. The x-ray tube of claim 27, wherein the shield comprises x-ray transmissive material.

29. The x-ray tube of claim 26, wherein said means is coupled to the envelope.

* * * * *